US007958595B2

(12) United States Patent
Goff

(10) Patent No.: US 7,958,595 B2
(45) **Date of Patent: *Jun. 14, 2011**

(54) FLOOR CLEANING APPARATUS

(75) Inventor: Sean K. Goff, Union Grove, WI (US)

(73) Assignee: Nilfisk-Advance, Inc., Plymouth, MN (US)

( * ) Notice: Subject to any disclaimer, the term of this patent is extended or adjusted under 35 U.S.C. 154(b) by 70 days.

This patent is subject to a terminal disclaimer.

(21) Appl. No.: 12/042,244

(22) Filed: Mar. 4, 2008

(65) Prior Publication Data

US 2010/0229891 A1 Sep. 16, 2010

Related U.S. Application Data

(63) Continuation of application No. 10/683,026, filed on Oct. 10, 2003, now Pat. No. 7,337,490.

(60) Provisional application No. 60/417,928, filed on Oct. 11, 2002.

(51) Int. Cl.
*A47L 11/30* (2006.01)

(52) U.S. Cl. ..... 15/320; 15/340.1; 15/340.4; 15/365; 15/367; 15/373; 15/401; 15/384

(58) Field of Classification Search ..... 15/320, 15/340.1–340.4, 401, 365, 367, 373, 384; *A47I 11/30*

See application file for complete search history.

(56) References Cited

U.S. PATENT DOCUMENTS 4,586,208 A 5/1986 Trevarthen
4,817,233 A 4/1989 Waldhauser
4,953,254 A 9/1990 Kohl et al.
5,016,310 A 5/1991 Geyer et al.
5,088,149 A 2/1992 Berg et al.
5,319,828 A 6/1994 Walderhauser et al.
5,465,456 A 11/1995 Fellhauer et al.
5,483,718 A 1/1996 Blehert et al.
5,515,568 A 5/1996 Larson et al.
5,970,571 A 10/1999 Ochss

OTHER PUBLICATIONS

TOMCAT Product Literature, Models: 3700, 5100 Disk; 3700, 5100 Cylindrical, Mid-Central Corporation (2000).
TOMCAT Product Literature, Models: 2100, 2300, 2500, 2700 Disk; 2200, 2800 Cylindrical, Mid-Central Corporation (2000).
TOMCAT Product Literature, Models: 290 Disk and Cylindrical; 350 Disk and Cylindrical, Mid-Central Corporation (2001).
TOMCAT Product Literature, Models: 3300 Walk-Behind Sweeperk; 4700 Rider Sweeper, Cylindrical, Mid-Central Corporation (2001).
TOMCAT Product Literature, Commerical Cleaing Equipment, Full Line Brochure, Mid-Central Corporation (2001).

(Continued)

*Primary Examiner* — David A Redding
(74) *Attorney, Agent, or Firm* — Alan Kamrath; Kamrath & Associates PA

(57) ABSTRACT

A cleaning apparatus having a cleaning system including at least one downwardly directed spray nozzle is supported by the chassis proximal the chassis forward end and in fluid communication with at least one cleaning solution tank. The at least one spray nozzle sprays cleaning solution from the tank onto the floor. At least one ground engaging agitation brush is disposed rearwardly of the at least one spray nozzle for agitating the cleaning solution sprayed onto the floor. At least one vacuum shoe is supported by the chassis rearwardly of the at least one agitation brush, and in fluid communication with the at least one recovery tank. Cleaning solution drawn into the vacuum shoe is deposited into the at least one recovery tank. In one embodiment, the apparatus is drivable. In another embodiment, the apparatus includes a second cleaning system including a vacuum squeegee.

41 Claims, 13 Drawing Sheets

OTHER PUBLICATIONS

Factory Cat Product Literature, Industrial Cleaning Equipment, R.P.S. Corporation.

Factory Cat Product Literature, Models: 21, 23, 25, 27 Disk; 22, 26, 28 Cylindrical, R.P.S. Corporation (2000).

Factory Cat Product Literature, Models: 290 Disk and Cylindrical; 350 Disk and Cylindrical, R.P.S. Corporation (2001).

Factory Cat Product Literature, Models 34, R.P.S. Corporation (2000).

Factory Cat Product Literature, Models 29/35, R.P.S. Corporation (2000).

Factory Cat Product Literature, Models 40/52, R.P.S. Corporation (2000).

Advance Product Literature, AquaMAX Automatic Extractor, Nilfisk-Advance, Inc. (2001).

FLOOR CLEANING APPARATUS

CROSS REFERENCES TO RELATED APPLICATIONS

This application is a continuation application of U.S. patent application Ser. No. 10/683,026 filed on Oct. 10, 2003, now U.S. Pat. No. 7,337,490, which claims the priority benefit of U.S. Provisional Patent Application No. 60/417,928 filed on Oct. 11, 2002.

STATEMENT REGARDING FEDERALLY SPONSORED RESEARCH

Not Applicable.

BACKGROUND OF THE INVENTION

The field of invention is floor cleaning equipment, and more particularly, floor cleaning equipment for use in industrial and commercial environments.

Industrial and commercial floors are cleaned on a regular basis for aesthetic and sanitary purposes. There are many types of industrial and commercial floors ranging from hard surfaces, such as concrete, terrazzo, wood, and the like, which can be found in factories, schools, hospitals, and the like, to softer surfaces, such as carpeted floors found in restaurants and offices. Different types of floor cleaning equipment, such as scrubbers, sweepers, and extractors, have been developed to properly clean and maintain these different floor surfaces.

A typical scrubber, such as Factory Cat scrubbers available from R.P.S. Corporation, Racine, Wis. and TOMCAT scrubbers available from Mid-Central Corporation, Racine, Wis., is a walk-behind or drivable, self-propelled, wet process machine which applies a liquid cleaning solution from an on-board cleaning solution tank onto the floor through nozzles fixed to a forward portion of the scrubber. Rotating brushes forming part of the scrubber rearward of the nozzles agitate the solution to loosen dirt and grime adhering to the floor. The dirt and grime become suspended in the solution which is collected by a vacuum squeegee fixed to a rearward portion of the scrubber and deposited into an onboard recovery tank.

Scrubbers are very effective for cleaning hard surfaces. Unfortunately, debris on the floor can clog the vacuum squeegee, and thus, the floor should be swept prior to using the scrubber. The traversing speed of the walk behind scrubber is limited by the walking speed of the operator walking behind the scrubber. Moreover, scrubbers are ineffective on soft surfaces, such as carpeting, because the dirty solution can be absorbed by the soft surface and the squeegee cannot effectively collect the absorbed dirty solution.

A sweeper can be used to sweep a floor prior to using a scrubber. A typical sweeper, such as available from R.P.S. Corporation and Mid-Central Corporation, is a self propelled, walk-behind or drivable dry process machine which picks debris off a hard or soft floor surface without the use of liquids. The typical sweeper has rotating brushes which sweep debris into a hopper or "catch bin." Unfortunately, the sweeper does not effectively remove dirt and grime adhering to the floor surface.

Soft floor surfaces, such as carpets, can be cleaned using an extractor. A typical extractor is a walk-behind machine which sprays a cleaning solution from an onboard tank onto the floor surface. A brush can be provided which agitates the cleaning solution and loosens dirt and grime adhering to the floor. The dirt and grime become suspended in the solution which is drawn into an onboard recovery tank through one or more vacuum shoes rearward of the brushes. Although an extractor can be used on a hard surface, it is not as effective as a scrubber, because the squeegee contributes to loosening the dirt and grime from the floor surface and dries the hard floor more effectively. Moreover, the extractor traversing speed is limited to the walking speed of the operator.

BRIEF SUMMARY OF THE INVENTION

The present invention provides a wet process floor cleaning apparatus. The cleaning apparatus includes a chassis having a forward end and a rearward end. A plurality of floor engaging wheels support the chassis above a floor. At least one of the floor engaging wheels is rotatably driven to propel the chassis along the floor. At least one first tank is supported by the chassis for holding a cleaning solution, and at least one second tank is supported by the chassis for holding recovered cleaning solution.

The cleaning apparatus includes a wet process cleaning system having at least one downwardly directed spray nozzle supported by the chassis proximal the chassis forward end and in fluid communication with the at least one first tank. The at least one spray nozzle sprays cleaning solution from the at least one first tank onto the floor. At least one ground engaging agitation brush is disposed rearwardly of the at least one spray nozzle for agitating the cleaning solution sprayed onto the floor. At least one vacuum shoe is supported by the chassis rearwardly of the at least one agitation brush, and is in fluid communication with the at least one second tank, wherein cleaning solution drawn into the vacuum shoe is deposited into the at least one second tank.

In one embodiment of the invention, the cleaning apparatus is a drivable extraction cleaning apparatus suitable for use on an absorbent floor surface, such as carpet. In another embodiment, the cleaning apparatus includes both an extraction system and a squeegee system which can effectively clean a hard or soft floor surface using a liquid cleaning solution. Moreover, the apparatus can sweep the floor prior to drawing the cleaning solution into a vacuum system to eliminate the need to sweep the floor prior to cleaning.

A general objective of the present invention is to provide a cleaning apparatus which is not limited to the walking speed of the operator. This objective is accomplished by providing a drivable chassis which supports a floor cleaning system.

Another objective of the present invention is to provide a cleaning apparatus which can effectively clean both a hard surface and an absorbent surface. This objective is accomplished by providing a cleaning apparatus having both an extraction system and a squeegee system.

The foregoing and other objectives and advantages of the invention will appear from the following description. In the description, reference is made to the accompanying drawings which form a part hereof, and in which there is shown by way of illustration a preferred embodiment of the invention.

DETAILED DESCRIPTION OF THE PREFERRED EMBODIMENTS

Figure 1:
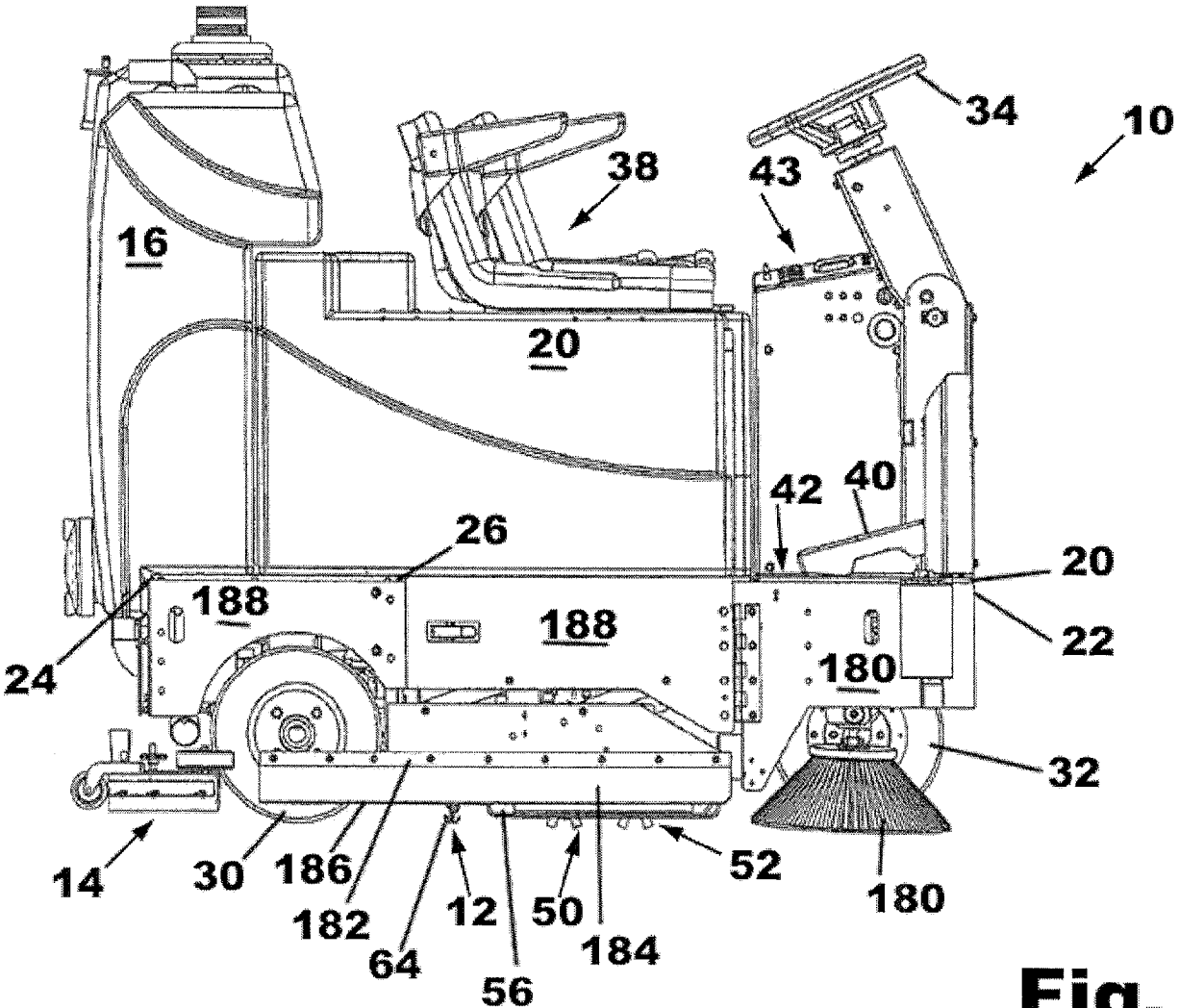
FIG. 1 is a right side view of a cleaning apparatus incorporating the present invention.
Figure 2:
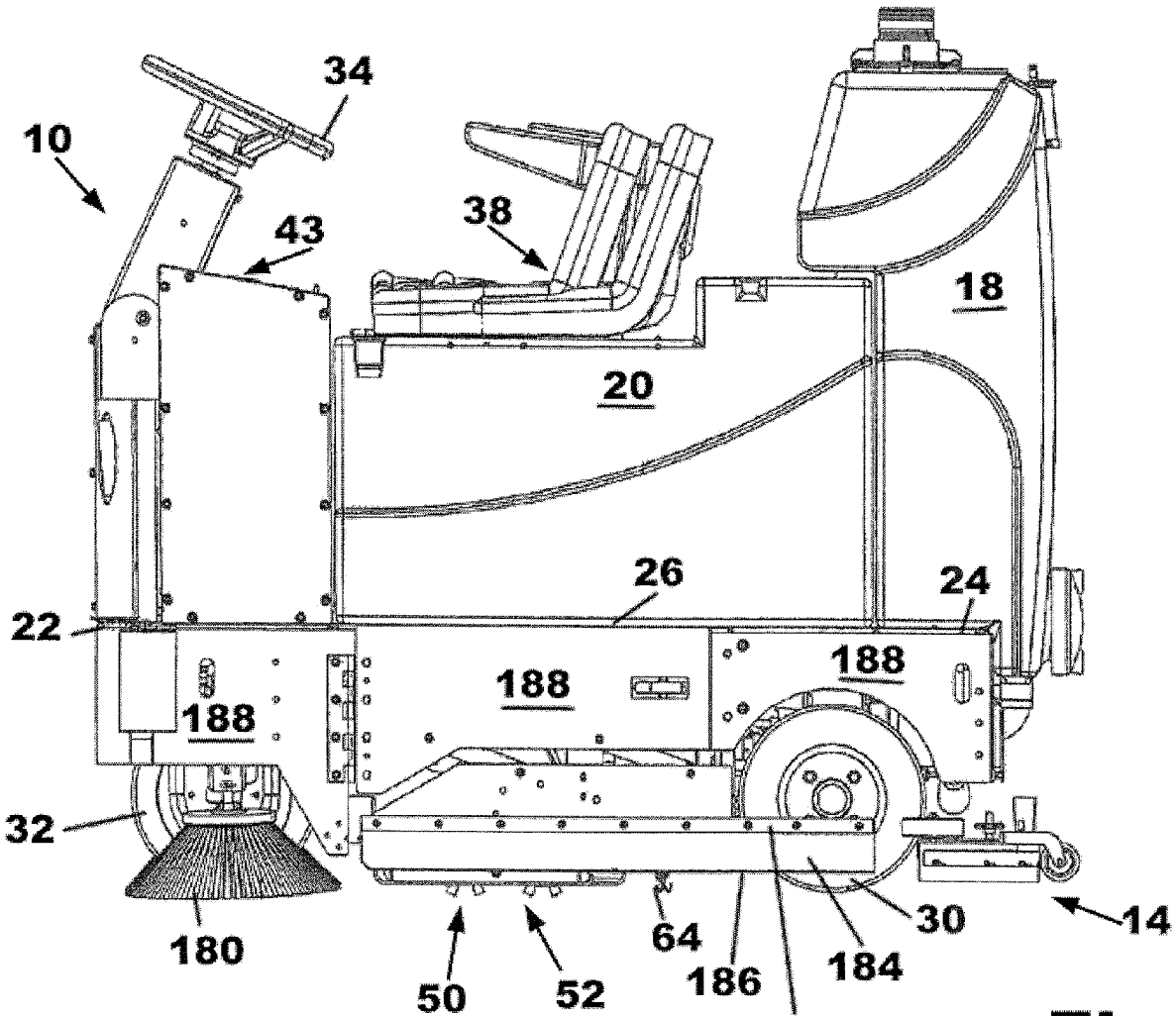
FIG. 2 is a left side view of the apparatus of FIG. 1.

As shown in FIGS. 1-4, a drivable wet process floor cleaning apparatus 10 includes an extraction system 12 for cleaning soft absorbent surfaces, such as carpeting, and a squeegee system 14 for cleaning hard surfaces. The apparatus 10 sprays a liquid cleaning solution from an onboard cleaning solution or first tank 16 onto the floor 17 being cleaned, agitates the cleaning solution, and then using suction draws the cleaning solution into an on board recovery or second tank 18. Providing a drivable wet process floor cleaning apparatus 10 having both an extraction system 12 and a squeegee system 14 allows the operator to operate the drivable wet process floor cleaning apparatus 10 in either a squeegee mode or an extraction mode.

The drivable wet process floor cleaning apparatus 10 includes a chassis 20 having a forward end 22 and a rearward end 24 joined by sides 26. The chassis 20 is supported by floor engaging rear wheels 30 and a front steerable wheel 32. The front steerable wheel 32 is operatively connected to a steering wheel 34 through the chassis 20 proximal the chassis forward end 22.

The chassis 20 houses a plurality of batteries (not shown) which provide electrical power to an electric drive motor 29 coupled to the steerable wheel 32. The batteries also provide electrical power to other electrical components described below. The drive motor 29 rotatably drives the steerable wheel 32 to propel the drivable wet process floor cleaning apparatus 10 along the floor 17. Although an electric motor powered by the batteries for rotatably driving the steerable wheel 32 is preferred, the rear wheels 30 can be rotatably driven by an electric motor, and/or the steerable wheel 32 can be driven by other means, such as an internal combustion engine powered by gasoline, natural gas, and the like, without departing from the scope of the invention.

A driver seat 38 is supported by the chassis 20 rearward of the steering wheel 34 for use by an operator operating the drivable wet process floor cleaning apparatus 10. The operator sits on the driver seat 38 to operate the steering wheel 34 and foot operated control pedals 40, such as a brake and accelerator supported above the chassis top surface 42. The first tank 16 and the second tank 18 are supported by the chassis 20 rearwardly of the driver seat 38 and proximal the chassis rearward end 24. The first tank 16 and the second tank 18 can be formed from any material known in the art, such as plastic, metal, fiberglass, and the like without departing from the scope of the invention.

A control panel 43 is supported by the chassis 20 proximal one of the chassis sides 26 and within reach of the operator sitting on the driver seat 38. The control panel 43 houses circuitry for controlling the electric drive motor 29 and the other electrical components described below. Control circuitry for controlling motors, pumps, and other electrical components is known in the art, such as control circuitry available on TOMCAT cleaning equipment available from Mid-Central Corporation in Racine, Wis.

Referring to FIGS. 2-5, the extraction system 12 includes a downwardly directed spray nozzle 44 supported by the chassis 20 above the floor 17 being cleaned, and is in fluid communication with the cleaning solution tank 16. The spray nozzle 44 sprays the cleaning solution onto the floor 17 proximal the chassis forward end 22 as the apparatus 10 is driven on the floor 17 by the operator. The cleaning solution can be gravity fed through the spray nozzle 44, or pumped out of the cleaning solution tank 16 through the spray nozzle 44 without departing from the scope of the invention.

The cleaning solution sprayed onto the floor 17 is agitated by a pair of ground engaging agitation brushes 50, 52 disposed rearwardly of the spray nozzle 44. The ground engaging agitation brushes 50, 52 have parallel axes of rotation 51 which are aligned transverse to the apparatus longitudinal centerline 53 to provide a forward ground engaging agitation brush 50 and a rearward ground engaging agitation brush 52. The ground engaging agitation brushes 50, 52 are rotatably driven by an electrical motor, and agitate the cleaning solution on the floor 17 using radially extending bristles 60 to dislodge dirt and grime adhering thereto. Advantageously, the dirt and grime are then suspended in the cleaning solution which can be drawn into the recovery tank 18, as described below. Although counter rotating cylindrical brushes are preferred, other agitating means, such as one or more disk brushes, a single cylindrical brush, and the like, can be used without departing from the scope of the invention.

Figure 3:
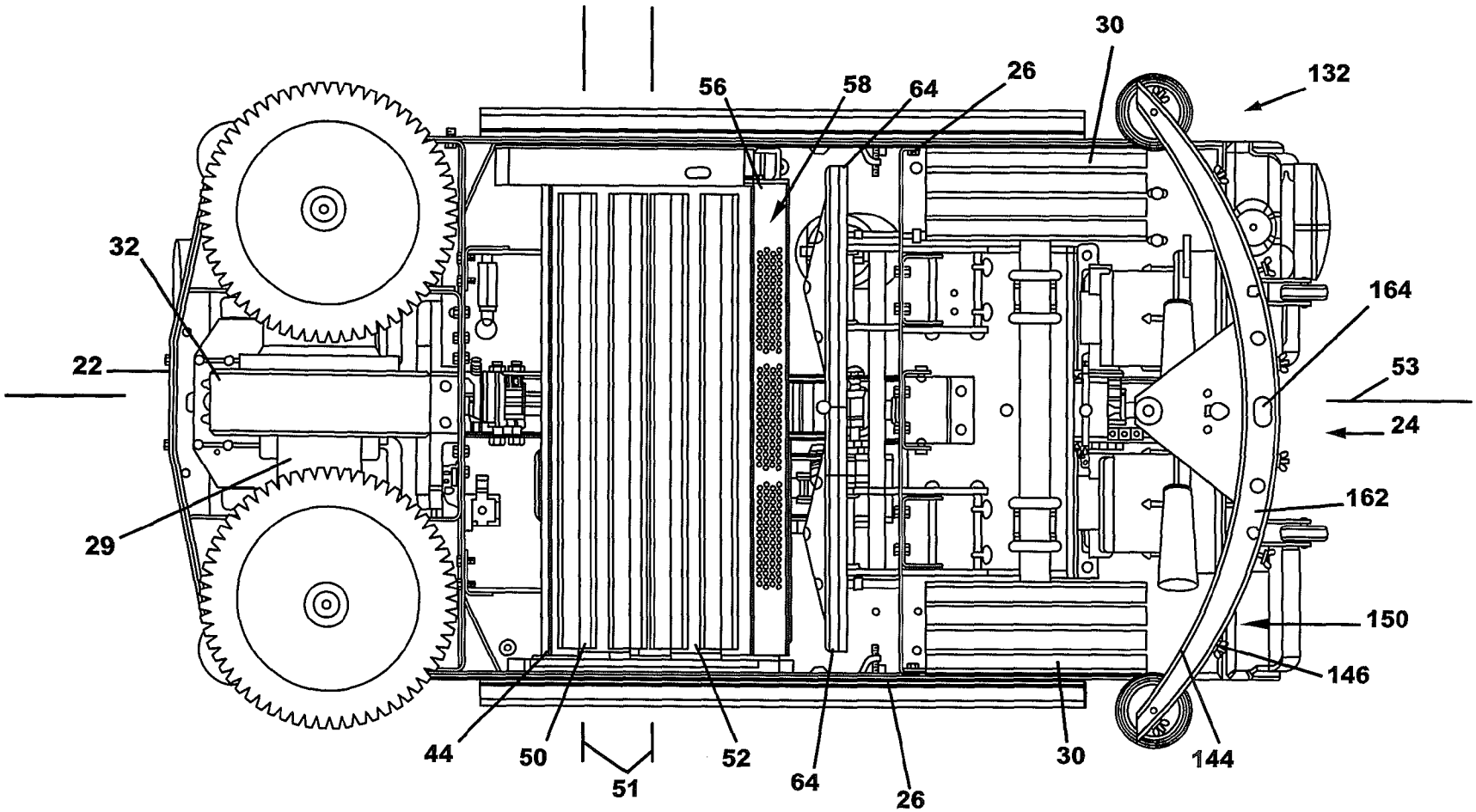
FIG. 3 is a bottom view of the apparatus of FIG. 1.
Figure 4:
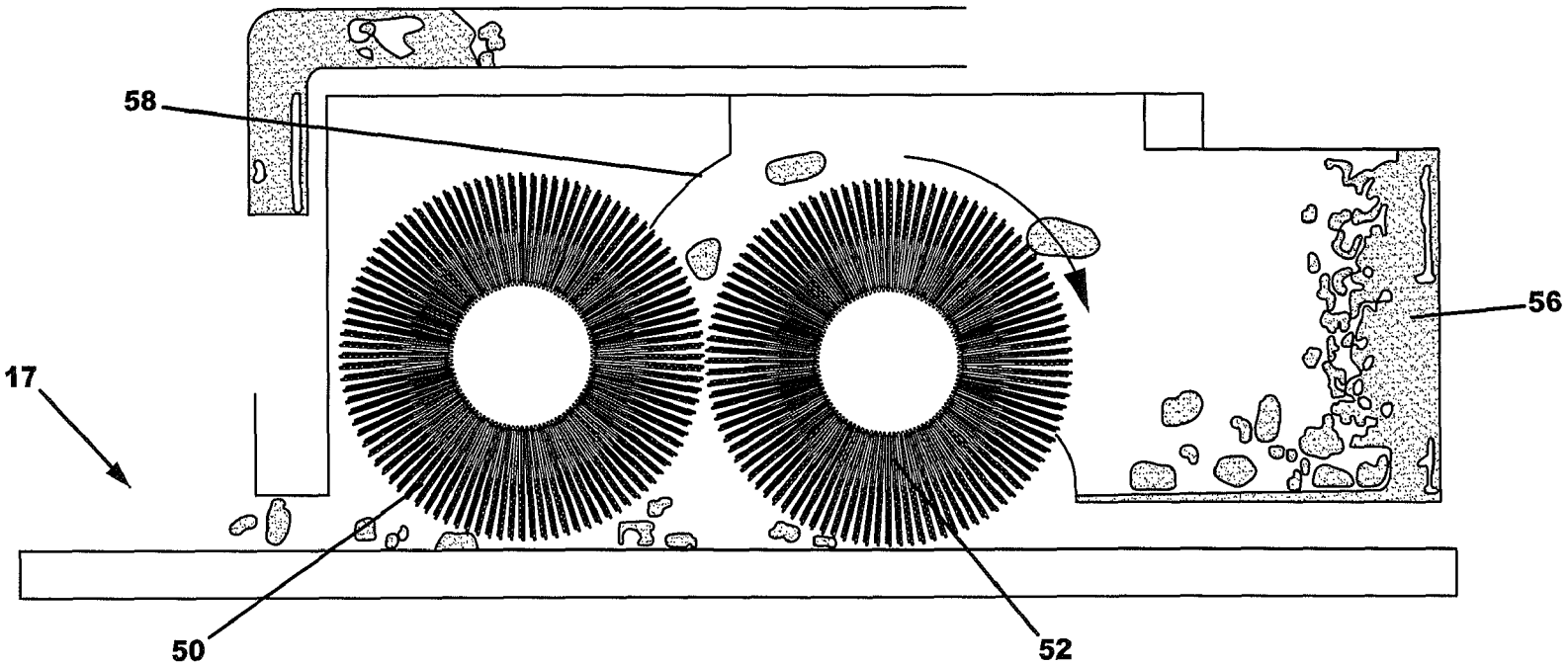
FIG. 4 is a cross sectional view of the cylindrical brushes and strainer of the apparatus of FIG. 1.

As shown in FIGS. 3 and 4, debris on the floor 17 is drawn up off the floor 17 between the ground engaging agitation brushes 50, 52 by the brush bristles 60 to eliminate the need to sweep the floor 17 before cleaning. The rearward ground engaging agitation brush 52 deposits the debris in a strainer 56 disposed rearwardly of the rearward ground engaging agitation brush 52. A brush bar 57 engaging the bristles 60 of the forward ground engaging agitation brush 50 prevents the forward ground engaging agitation brush 50 from depositing debris back onto the floor 17, and deflects the debris onto the rearward ground engaging agitation brush 52 for deposition into the strainer 56. Preferably, the strainer 56 includes drain holes 58 which allows cleaning solution deposited into strainer 56 to drip back onto the floor 17. Preferably, the control circuitry can vary the pressure exerted by the ground engaging agitation brushes 50, 52 against the floor depending upon the mode of operation selected by the operator. Most preferably, the ground engaging agitation brushes 50, 52 can be raised to a storage position in which they do not engage the floor 17.

Referring to FIGS. 3 and 5-8, a pair of vacuum shoes 64 disposed rearwardly of the ground engaging agitation brushes 50, 52 draw the cleaning solution along with the suspended dirt and grime off the floor 17. The vacuum shoes 64 are pivotally mounted to shoe support brackets 66 which are pivotally supported beneath the chassis 20 to provide a shoe operating position (shown in FIG. 5) and a stored position (shown in FIG. 6). In the operating position, the vacuum shoes 64 engage the floor 17 immediately behind the rearward ground engaging agitation brush 52 (i.e. within approximately one foot behind the rearward brush) and are connected to a vacuum source which provides a suction to draw the cleaning solution out of the floor 17. In the stored position, the vacuum shoes 64 are raised out of engagement with the floor 17. Preferably, in the stored position, the vacuum shoes 64 are disconnected from the vacuum source.

Each vacuum shoe 64 is formed from a pair of spaced triangular sheets 68 of gas impermeable material, such as metal, plastic, and the like, sealingly joined at two edges 70 to form an elongated inlet 72 opening toward the floor 17. A shoe outlet 73 formed through one of the sheets 68 of material is connected to the vacuum source. Each shoe outlet 73 is, preferably, connected to the vacuum source by a flexible hose 74 which allows the vacuum shoe 64 to move between the operating and stored position.

The elongated inlet 72 includes arcuate lips 76 which engage the floor 17. Each arcuate lip 76 has a free edge 78 which curls rearwardly away from the floor 17 to form the elongated inlet 72 therebetween. Advantageously, the arcuate lips 76 allow the vacuum shoe 64 to slide along the floor 17 without snagging a floor imperfection or thread as the drivable wet process floor cleaning apparatus 10 travels across the floor 17 in either a forward or reverse direction.

Figure 7:
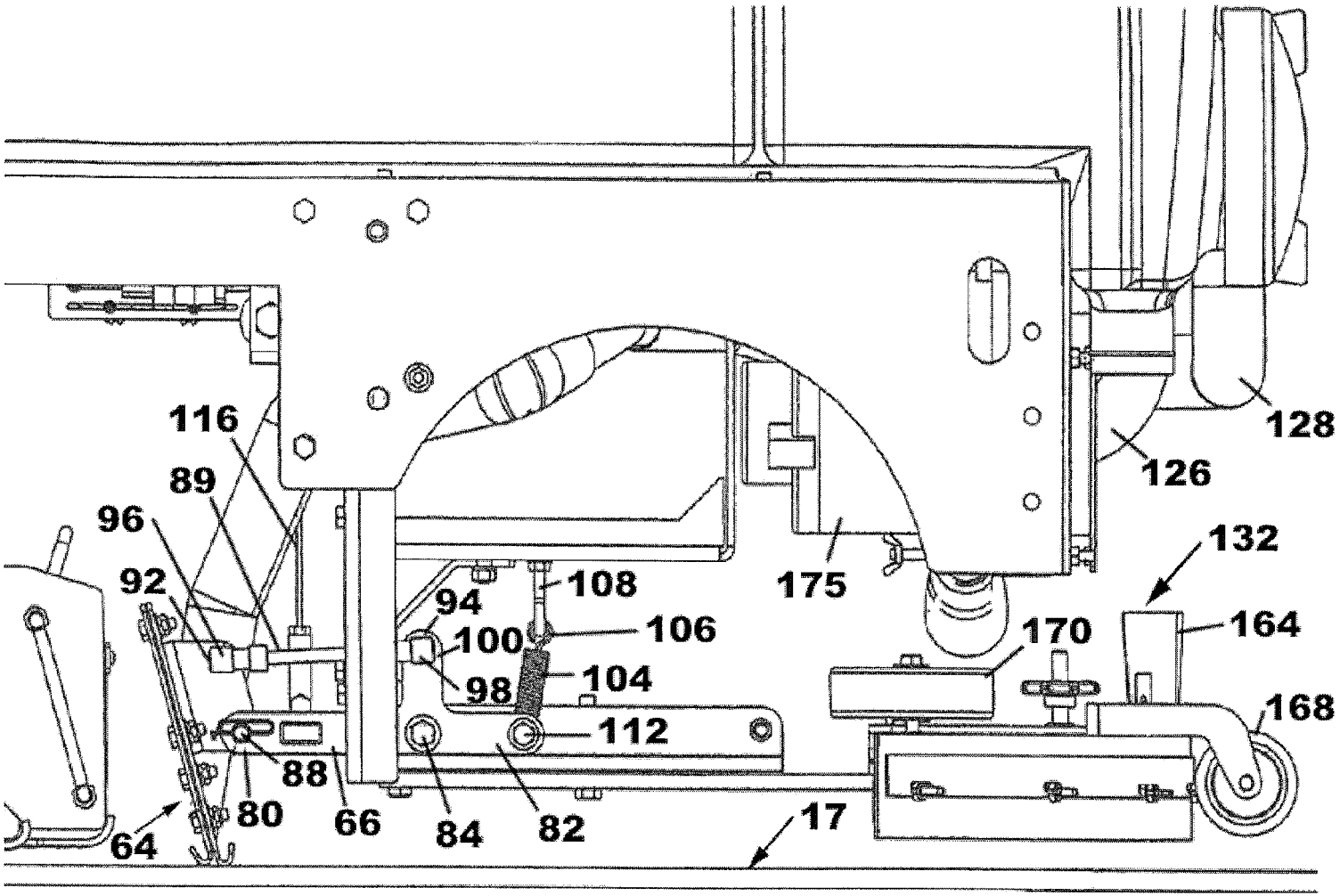
FIG. 7 is a cut away side view of a partially disassembled apparatus of FIG. 1.
Figure 8:
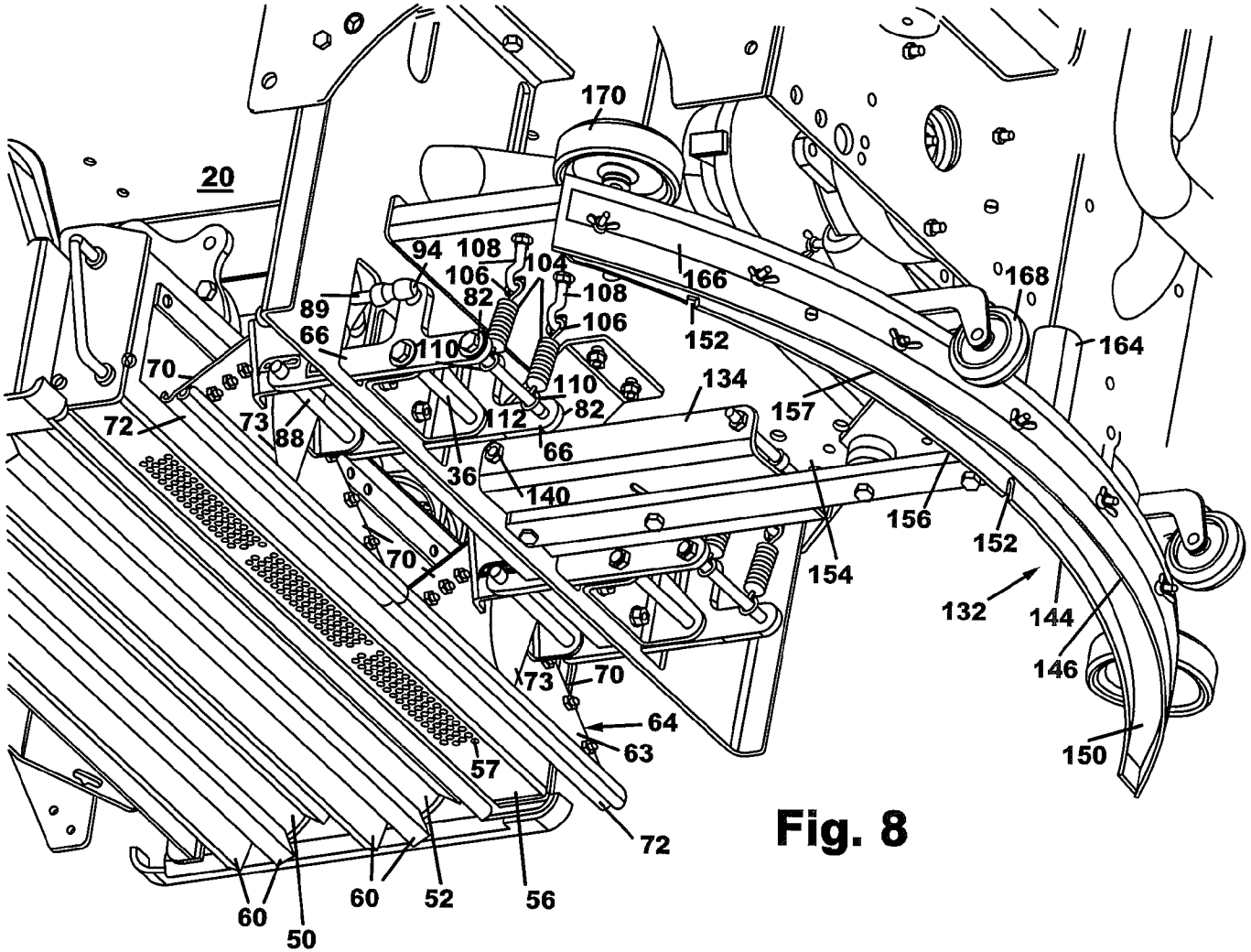
FIG. 8 is a left, bottom cut away perspective view of the apparatus of FIG. 1.

As shown in FIGS. 7 and 8, each shoe support bracket 66 is pivotally mounted to the chassis 20, and includes a forward end 80 and a rearward end 82. The pivot point 84 of the bracket 66 is interposed between the forward and rearward ends 80, 82, such that raising the rearward end 82 causes the forward end 80 to lower, and vice versa. Preferably, the bracket pivot point 84 is defined by a shaft 86 fixed relative to the chassis 20, and extends through and joins two adjacent brackets 66.

Each vacuum shoe 64 is pivotally mounted to the forward end 80 of two adjacent shoe support brackets 66 by a pivot rod 88, and is secured at a desired angle A relative to the floor 17 by an adjustment rod 89 having threaded ends 92, 94. Each rod end 92, 94 is respectively received in internally threaded nut 96, 98. One of the nuts 96 is fixed relative to the vacuum shoe 64, and the other nut 98 is fixed to a finger 100 forming part of the bracket 66. Preferably, one end of the pivot rod 88 has reverse threads threadably received in a correspondingly threaded nut, such that the pivot rod 88 can be rotated to adjust the angle A, as desired by the operator.

The rearward end 82 of each bracket 66 is biased upwardly toward the chassis 20 by a pair of springs 104. Each spring 104 has one end 106 fixed to the chassis 20, such as by a threaded eyebolt 108, and an opposing end 110 connected to a second shaft 112 joining the rearward end 82 of the two adjacent brackets 66. Upwardly biasing the rearward end 82 of each bracket 66 biases the forward ends 80 of the brackets 66 downwardly to urge the vacuum shoes 64 against the floor 17 in the operating position. Advantageously, the threaded engagement of the threaded eyebolt 108 relative to the chassis 20 can be changed to modify the tension force exerted by the spring 104 on the second shaft 112 to adjust the force exerted by the vacuum shoe 64 against the floor 17. Although two springs are preferred to bias the rearward ends 82 of the brackets 66 upwardly, any biasing members known in the art, such as leaf springs, torsion springs, elastomeric materials, and the like can be used without departing from the scope of the invention. Moreover, although biasing the rearward end 82 of each bracket 66 upwardly is preferred, biasing the rearward end 82 of each bracket 66 is not required to practice the invention.

The vacuum shoes 64 are selectively pivoted upwardly to the stored position by a cable 116 connected to the brackets 66 between the bracket pivot point 84 and the bracket forward end 80. Preferably, an electric actuator 117 operable by the operator tensions the cables 116 to urge the bracket forward end 80 upwardly to raise the vacuum shoes 64. Of course, the cable 116 can be tensioned manually by the operator, such as by raising a lever connected to the cable 116, without departing from the scope of the invention. In addition, if the rearward end 82 of each bracket 66 is not biased upwardly, each vacuum shoe 64 can be pivoted upwardly by a rod, linkage, or other actuating device.

Figure 9:
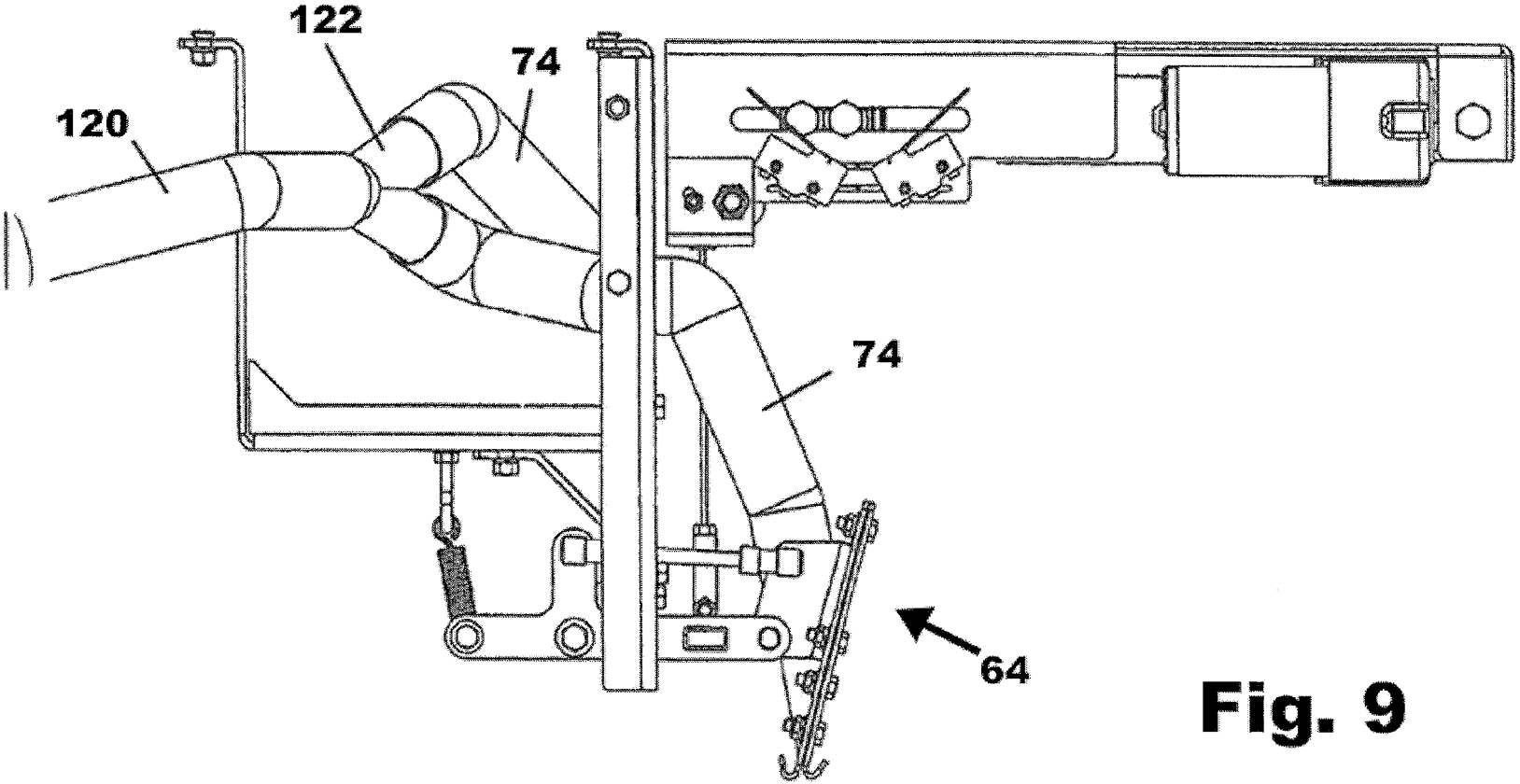
FIG. 9 is a side view of the vacuum shoes of FIG. 1.
Figure 10:
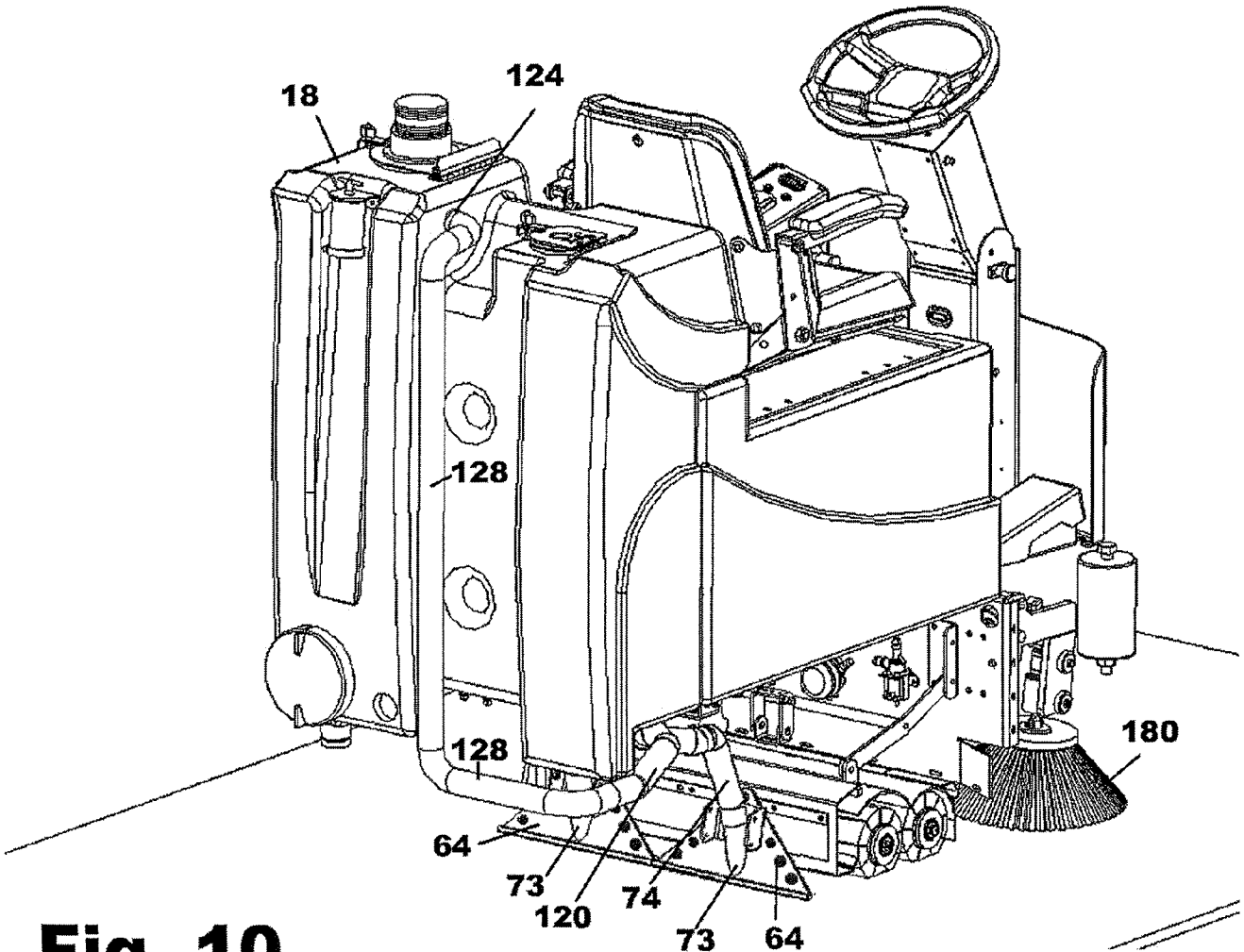
FIG. 10 is a rear, cut away perspective view of the apparatus of FIG. 1.
Figure 11:
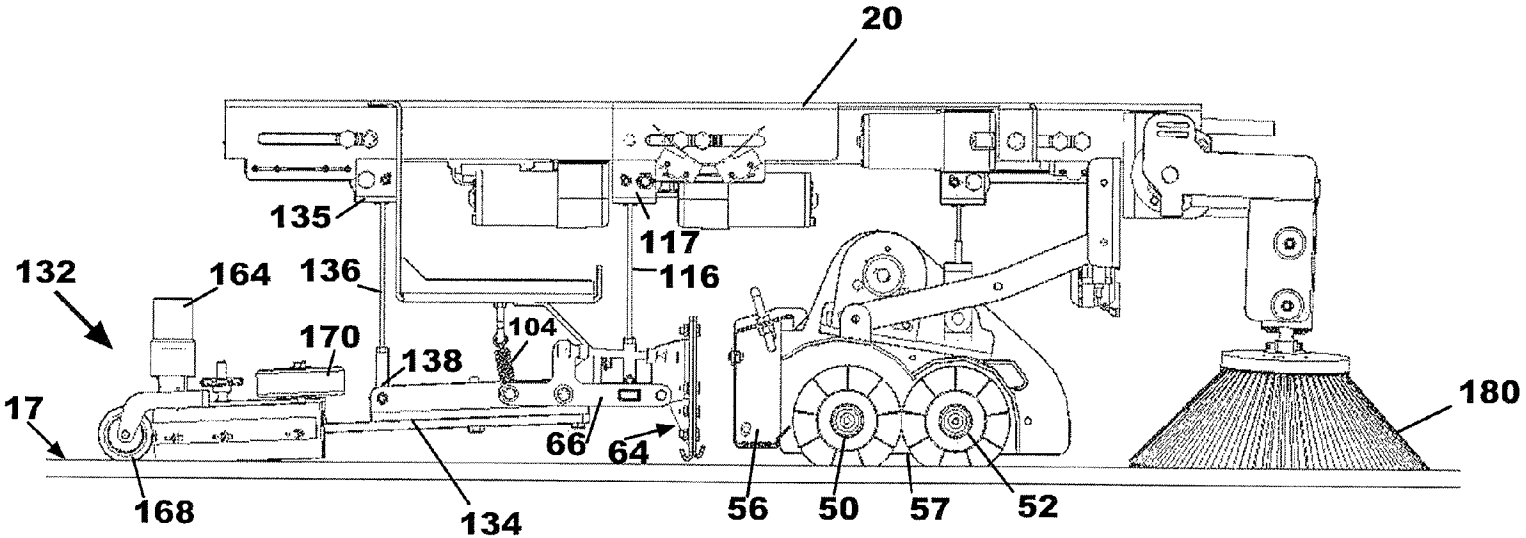
FIG. 11 is a side view of a partially disassembled apparatus of FIG. 2.

As shown in FIGS. 9 and 10, each hose 74 connected to each shoe outlet 73 is joined to a single hose 120 by a Y-connection 122. The single hose 120 extends rearwardly beneath the chassis rearward end 24 for connection to a recovery tank inlet 124 in the recovery tank 18. The recovery tank 18 is connected to the vacuum source, such as by a vacuum hose 126 (shown in FIG. 12), to draw the cleaning solution through the vacuum shoes 64 into the recovery tank 18. Preferably, the single hose 120 is connected to the recovery tank inlet 124 by a detachable recovery hose 128 which can be detached for use with the squeegee system 14 described below when the vacuum shoes 64 are in the stored position.

Referring to FIGS. 1, 3, 5-8, and 11, the squeegee system 14 includes the spray nozzle 44 and ground engaging agitation brushes 50, 52 described above, and further includes a floor engaging vacuum squeegee assembly 132. The spray nozzle 44 sprays cleaning solution onto the floor 17, as described above, and the ground engaging agitation brushes 50, 52 agitate the cleaning solution and pick up debris, as described above. When operating in a squeegee mode, the vacuum shoes 64 are in the stored position, and, preferably, disconnected from the vacuum source. The agitated cleaning solution and suspended dirt and grime are drawn off the floor 17 through the vacuum squeegee assembly 132 disposed proximal the chassis rear end 24.

Figure 5:
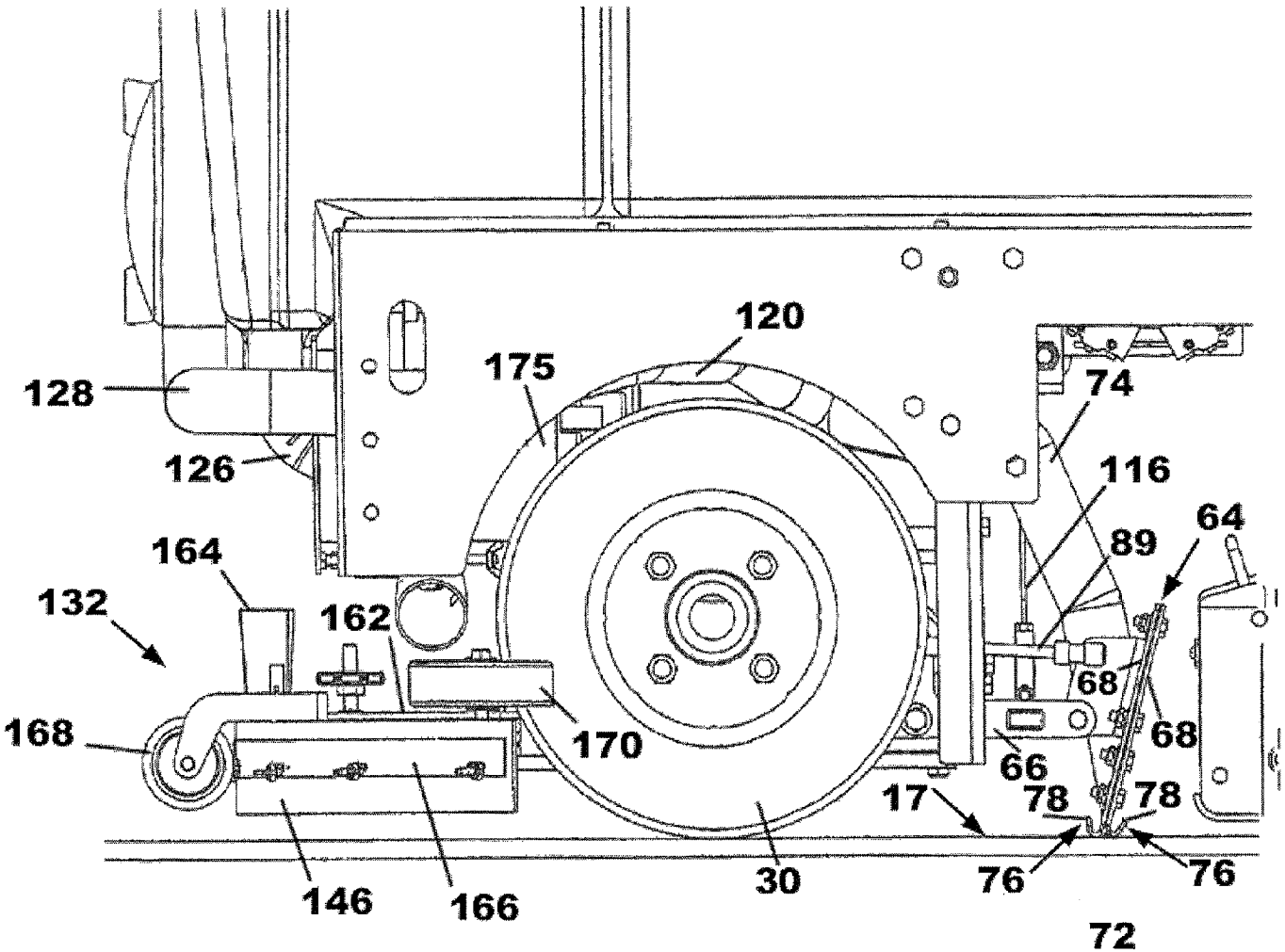
FIG. 5 is a cut away side view of FIG. 1 showing the shoes in an operating position and the squeegee assembly in the stored position.
Figure 6:
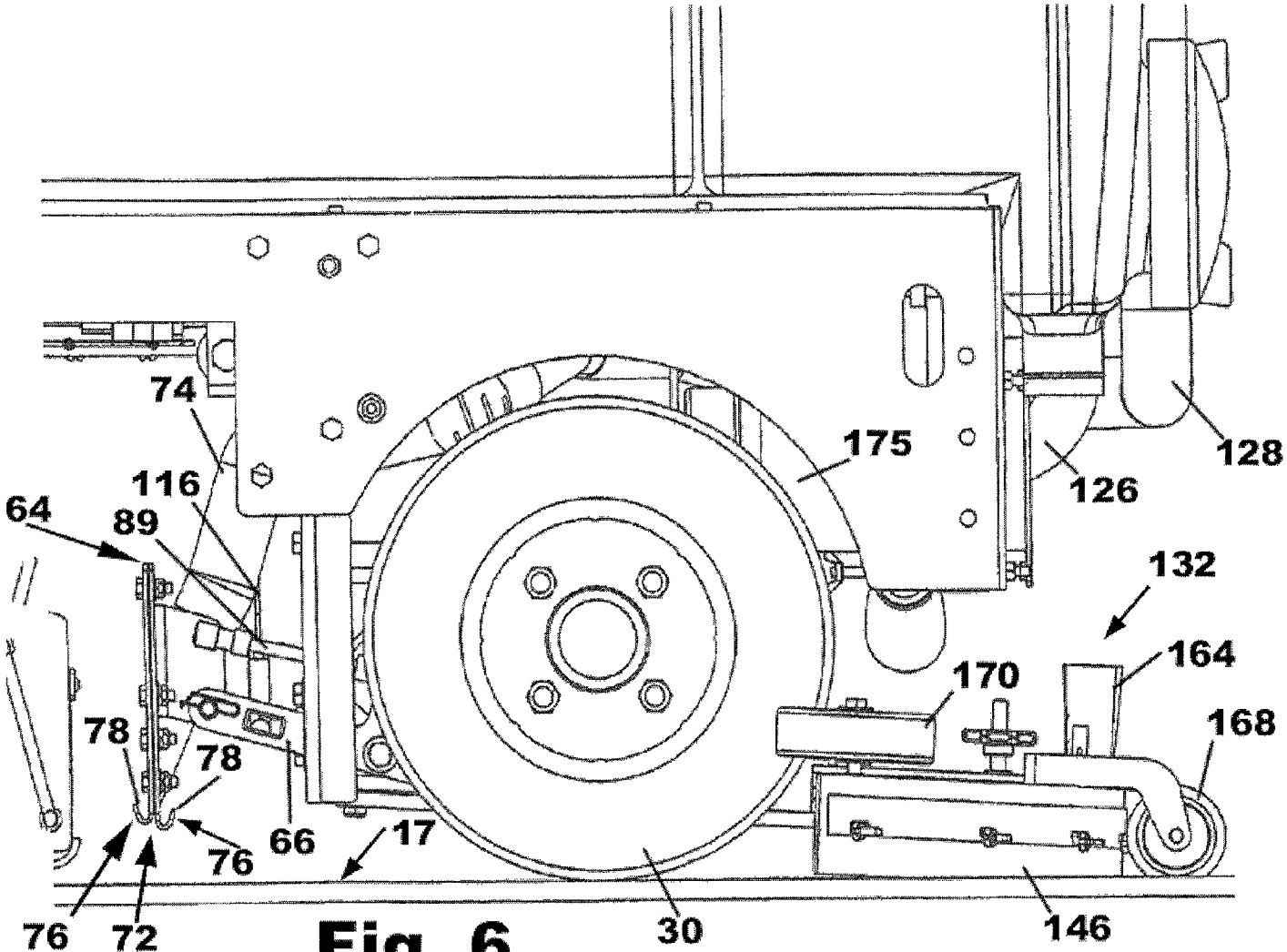
FIG. 6 is a cut away side view of FIG. 2 showing the shoes in a stored position and the squeegee assembly in the operating position.

The squeegee assembly 132 is fixed to a squeegee support bracket 134 pivotally fixed relative to the chassis 20, and can be moved between an operating position (shown in FIG. 6) and a stored position (shown in FIG. 5). A cable 136 having one end 138 connected to the squeegee support bracket 134 is connected to an actuating mechanism 135, such as a lever, electrical actuator, and the like, operable by the operator which tensions the cable 136 to pivot the bracket 134 about a third shaft 140 and raise the squeegee assembly 132 to the stored position. Relieving the tension in the cable 136 allows the bracket 134 to pivot downwardly under the weight of the squeegee assembly 132 and return to the operating position.

The vacuum squeegee assembly 132 dries the surface of a hard floor being cleaned by the apparatus 10, and includes a forward arcuate squeegee strip 144 nested in a rearward arcuate squeegee strip 146. The nested squeegee strips 144, 146 extend across the width of the apparatus, and define a crescent shaped vacuum zone 150. Preferably, the squeegee strips 144, 146 are formed from a flexible, elastomeric material, such as rubber, plastic, and the like, which can sealingly engage the floor 17.

The forward squeegee strip 144 collects the cleaning solution on the floor 17, and includes notches 152 in its floor engaging edge 154 which allows the cleaning solution to enter the vacuum zone 150. The rearward squeegee strip 146 has a continuous floor engaging edge 156 which prevents the escape of the cleaning solution rearwardly from the vacuum zone 150.

The vacuum zone 150 has a top which is closed by a cap 162 having a cap outlet 164 connected to the vacuum source by the detachable recovery hose 128 which suctions the cleaning solution out of the vacuum zone 150 into the recovery tank 18. Preferably, the squeegee strips 144, 146 are clamped onto the cap 162 by clamp members 166 which squeeze the cap 162 between the squeegee strips 144, 146 to form the vacuum zone 150.

Squeegee support wheels 168 having a horizontal axis of rotation transverse to the direction of apparatus travel are cantilevered from the squeegee cap 162. The support wheels 168 engage the floor 17 when the squeegee assembly 132 is in the operating position to support the weight of the squeegee assembly 132. Advantageously, the support wheels 168 ensure the floor engaging edges 154, 156 of the respective squeegee strips 144, 146 properly engage the floor 17 without collapsing the squeegee strips 144, 146 under the weight of the squeegee assembly 132.

Side wheels 170 rotatable about a vertical axis are mounted to each transverse end 172 of the squeegee assembly 132. The side wheels 170 engage vertical surfaces adjacent the floor 17 being scrubbed to prevent the squeegee assembly 132 from hooking or catching the vertical surface which could damage the squeegee assembly 132.

Figure 12:
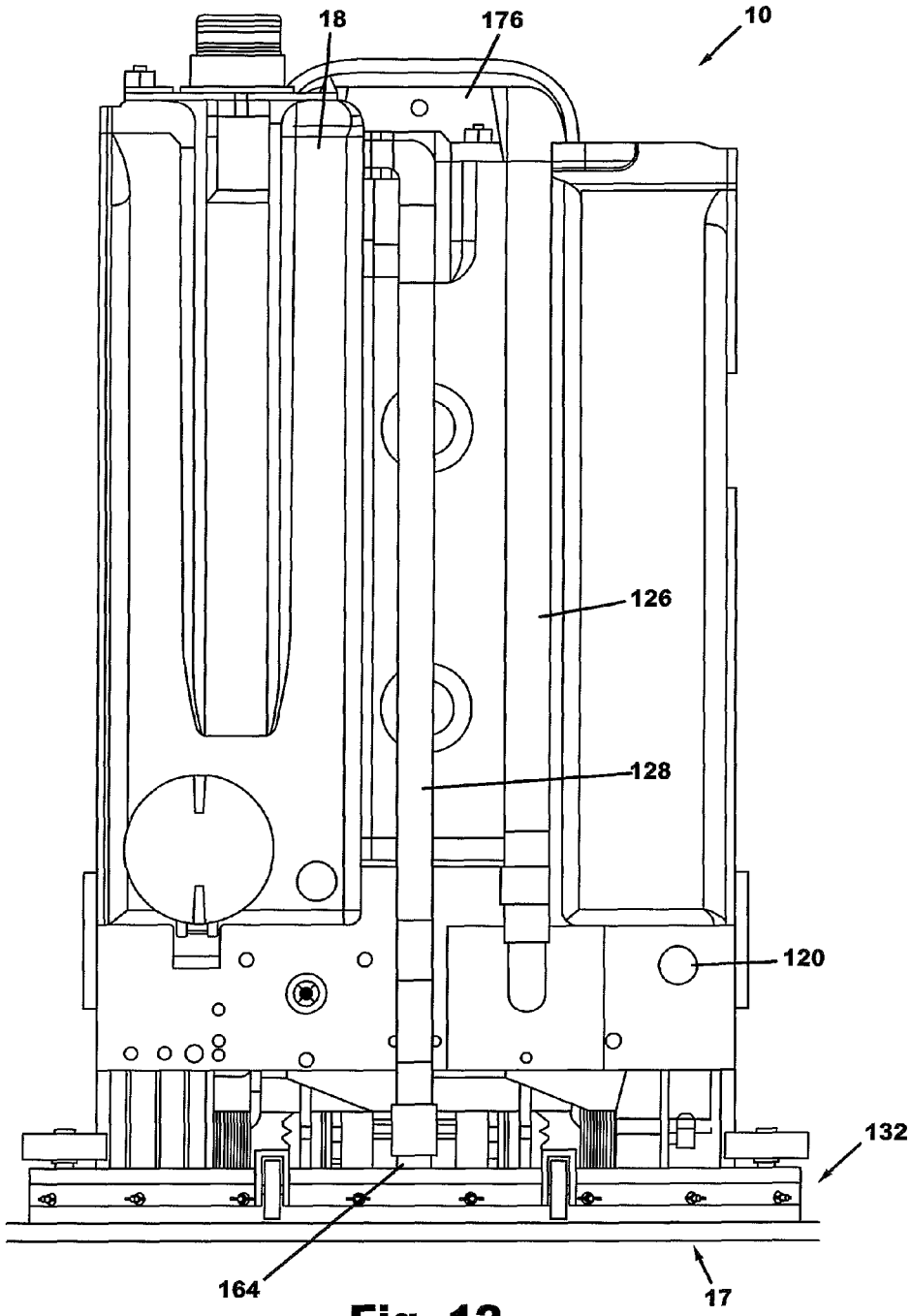
FIG. 12 is a rear view of the apparatus of FIG. 1 with the squeegee assembly in the operating position connected to the recovery or second tank.

As shown in FIG. 12, preferably, the vacuum source is a pair of vacuum pumps 175 (one is shown in FIG. 7) in fluid communication with an upper portion 176 of the recovery tank 18. The vacuum pumps 175 draw air out of the recovery tank 18 to create a partial vacuum. The recovery hose 128 is in fluid communication with the partial vacuum in the upper portion 176 of the recovery tank 18. The partial vacuum creates a suction in the recovery hose 128 which draws the cleaning solution into the recovery tank 18 through the squeegee assembly 132 or vacuum shoes 64 depending upon which particular component is connected to the recovery hose 128. Although dual vacuum pumps are disclosed, one or more vacuum pumps can be provided to provide the desired suction without departing from the scope of the invention.

Referring back to FIGS. 1 and 2, a pair of side disk brushes 180 are rotatably mounted proximal the chassis forward end 22 forward of the ground engaging agitation brushes 50, 52, and are driven by an electrical motor controlled by the control circuitry and powered by the batteries. Each side brush 180 is rotatable about a vertical axis proximal one of the chassis sides 26, and urges debris towards a centerline of the chassis 20 for pick up by the ground engaging agitation brushes 50, 52. Preferably, each side brush 180 extends radially from its vertical axis past one side 26 of the chassis 20 in order to sweep the floor 17 along a wall, or other vertical surface. Preferably, the side brushes 180 are vertically movable between an operating position and a storage position.

Side guards fixed to each side 26 of the chassis 20 include ground engaging strips 184. The ground engaging strips 184 include a ground, or floor, engaging edge 186 to prevent the cleaning solution from flowing transversely past the chassis sides 26 and beyond the reach of the vacuum shoes 64 or squeegee assembly 132. The ground engaging strips 184 are preferably formed from a flexible elastomeric material, such as described above for the squeegee strips 144, 146, and are clamped onto a support bracket 182 to form the guard. The support bracket 182 is fixed to the chassis 20 using fasteners, such as bolts, screws, and the like.

Access panels 188 fastened to the chassis 20 can be provided to protect the components beneath the chassis 20 and provide access thereto. The panels 188 can be formed from any suitable material, such as metal, plastic, and the like, and can be hingedly or detachably fixed to the chassis 20 using methods known in the art.

Referring to FIGS. 1-12, in operation, the cleaning apparatus 10 can operate in the extraction mode, the squeegee mode, or a transport mode. In the extraction mode, the squeegee assembly 132 is raised to the stored position, and the vacuum source is disconnected from the squeegee assembly 132 and connected to the vacuum shoes 64, such that suction is drawn through the elongated inlets 72. The vacuum shoes 64 are lowered to the operating position and urged against the floor 17 by the springs 104.

In the extraction mode, as the operator drives the apparatus 10 across the floor 17, the spray nozzle 44 sprays cleaning solution from the cleaning solution tank 16 onto the floor 17. The ground engaging agitation brushes 50, 52 counter rotate to agitate the cleaning solution on the floor 17 and pick up debris swept into the path of the apparatus 10 by the side brushes 180. The debris picked up by the ground engaging agitation brushes 50, 52 is deposited into the strainer 56 for later removal by the operator. As the apparatus 10 moves across the floor 17, the agitated cleaning solution is drawn out of and off the floor 17 by the vacuum shoes 64 and deposited into the recovery tank 18 for later disposal.

In the squeegee mode, the squeegee assembly 132 is lowered to the operating position, and the vacuum source is disconnected from the vacuum shoes 64 and connected to the squeegee assembly 132, such that the cleaning solution is suctioned off the floor 17 through the vacuum zone 150 between the squeegee strips 144, 146. The vacuum shoes 64 are raised to the storage position.

In the squeegee mode, as the operator drives the apparatus 10 across the floor 17, the spray nozzle 44 sprays cleaning solution from the cleaning solution tank 16 onto the floor 17. The ground engaging agitation brushes 50, 52 counter rotate to agitate the cleaning solution on the floor 17 and pick up debris swept into the path of the apparatus 10 by the side brushes 180. The debris picked up by the ground engaging agitation brushes 50, 52 is deposited into the strainer 56 for later removal by the operator. As the apparatus 10 moves across the floor 17, the agitated cleaning solution is collected by the squeegee assembly 132 and drawn off the floor 17 by the vacuum source through the cap outlet 164 and deposited into the recovery tank 18 for later disposal.

In the transport mode, the apparatus 10 can be driven without cleaning the floor 17 by raising the vacuum shoes 64, squeegee assembly 132, ground engaging agitation brushes 50, 52, and side brushes 180 to their respective storage positions and turning off the spray nozzle 44, such that the cleaning solution is not sprayed onto the floor 17. The motors rotatably driving the ground engaging agitation and side brushes 50, 52, 180 can be turned off to minimize power consumption.

Figure 13:
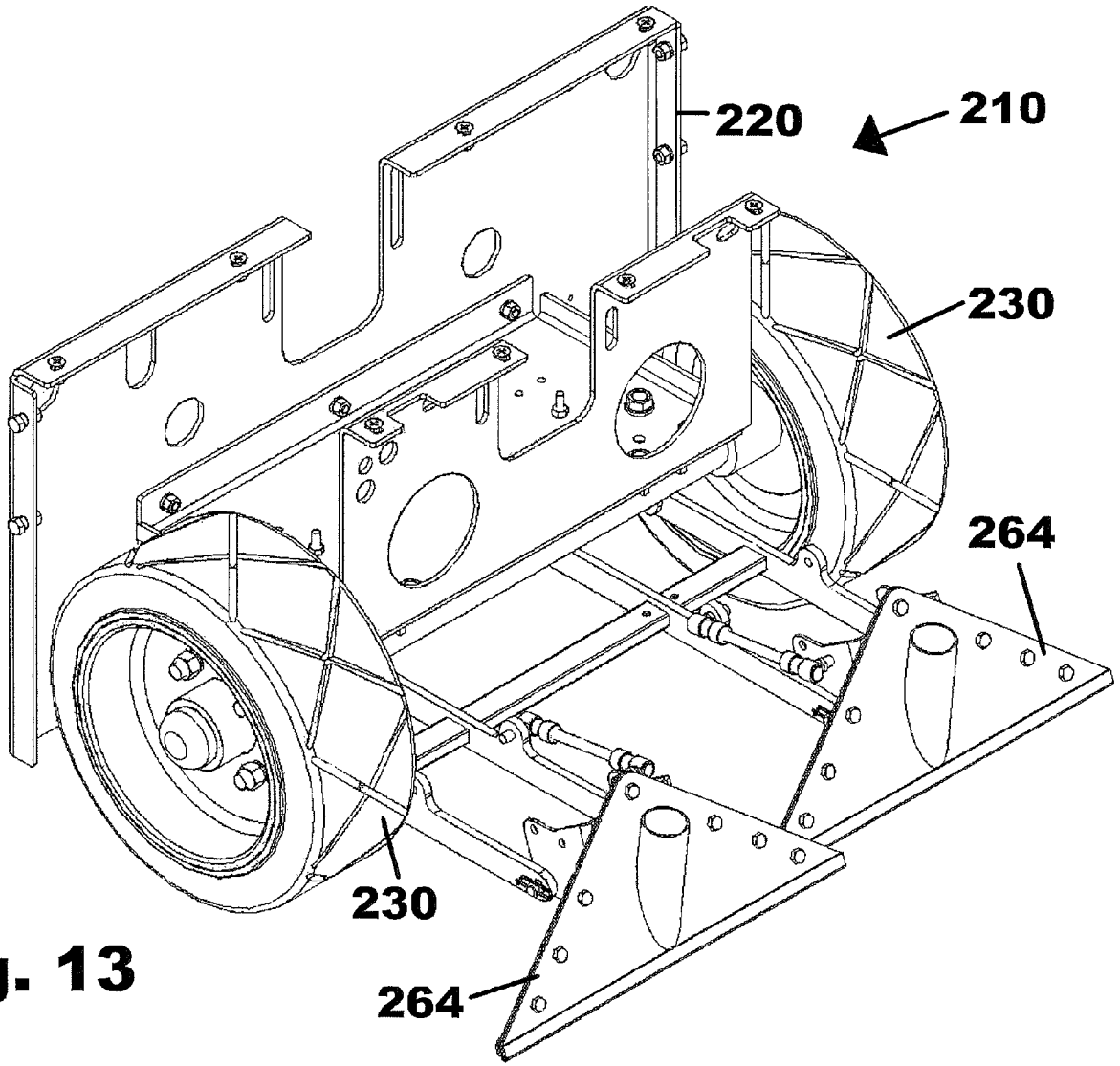
FIG. 13 is an alternative embodiment of a cleaning apparatus.

In an alternative embodiment disclosed in FIG. 13, a drivable floor cleaning apparatus 210, similar to the apparatus 10 described above, includes a chassis 220 supported by a front wheel (not shown) and rear wheels 230. In the embodiment disclosed in FIG. 13, vacuum shoes 264 are disposed rearwardly of the rear wheels 230, and mounted to the chassis 220 using a method, such as the method of mounting the vacuum shoes 64 to the chassis 20 described above. Advantageously, mounting the vacuum shoes 264 rearwardly of the rear wheels 230 eliminates tracks left by the wheels 230 in residual water and cleaning fluid on the floor being cleaned. Of course, the cleaning apparatus 210 can be provided with a squeegee system, such as disclosed above, without departing from the scope of the invention.

While there have been shown and described what is at present considered the preferred embodiments of the invention, it will be obvious to those skilled in the art that various changes and modifications can be made therein without departing from the scope of the invention defined by the appended claims.

I claim:

1. A floor cleaning apparatus comprising:

a chassis having a forward end and a rearward end;

a plurality of floor engaging wheels supporting said chassis above a floor;

at least one first tank supported by said chassis for holding a cleaning solution;

at least one second tank supported by said chassis for holding recovered cleaning solution;

wherein said cleaning solution from said at least one first tank is applied to the floor;

at least one ground engaging agitation brush for agitating the cleaning solution applied to the floor;

at least one vacuum shoe supported by said chassis rearwardly of where said cleaning solution is applied to the floor, wherein cleaning solution drawn into said vacuum shoe is deposited into said at least one second tank; and a squeegee assembly supported by said chassis rearwardly of said at least one agitation brush, wherein cleaning solution drawn into said squeegee assembly is deposited into said at least one second tank.

2. The cleaning apparatus as in claim 1, in which at least one of said floor engaging wheels is a steerable wheel steerable by a steering wheel supported by said chassis.

3. The floor cleaning apparatus as in claim 1, in which said vacuum shoe is mounted to one end of a bracket pivotally fixed relative to said chassis, wherein said vacuum shoe is movable between a stored position and an operating position.

4. The floor cleaning apparatus as in claim 1, in which said vacuum shoe is pivotally mounted relative to said chassis, wherein pivotal movement of said vacuum shoe changes the angle of said shoe relative to said floor.

5. The floor cleaning apparatus as in claim 4, wherein said angle of said shoe is fixable relative to said floor.

6. The floor cleaning apparatus as in claim 1, in which said squeegee assembly has an operating position and a stored position, wherein in said operating position said squeegee assembly engages the floor.

7. The floor cleaning apparatus as in claim 1, in which a vacuum source supported by said chassis is selectably in fluid communication with at least one of said at least one vacuum shoe and said squeegee assembly, wherein said vacuum source creates a suction for drawing cleaning solution applied to the floor into said at least one second tank.

8. The cleaning apparatus as in claim 1, in which said at least one agitation brush is cylindrical having an axis of rotation transverse to a longitudinal centerline extending through said forward end and said rearward end of said chassis.

9. The floor cleaning apparatus as in claim 1, further comprising:

at least one downwardly directed spray nozzle supported by said chassis proximal said chassis forward end and in fluid communication with said at least one first tank, wherein said cleaning solution from said at least one tank is applied to the floor by the at least one spray nozzle spraying said cleaning solution onto the floor, with the at least one ground engaging agitation brush and the at least one vacuum shoe disposed rearwardly of said at least one spray nozzle.

10. The cleaning apparatus as in claim 9, including a side brush supported by said chassis forwardly of said at least one spray nozzle for urging debris into the path of said cleaning apparatus.

11. A floor cleaning apparatus comprising:

a chassis having a forward end and a rearward end;

a plurality of floor engaging wheels supporting said chassis above a floor;

at least one first tank supported by said chassis for holding a cleaning solution;

at least one second tank supported by said chassis for holding recovered cleaning solution;

wherein said cleaning solution from said at least one first tank is applied to the floor;

at least one ground engaging agitation brush for agitating the cleaning solution applied to the floor;

at least one squeegee assembly fixed relative to said chassis and disposed rearwardly of said at least one agitation brush; and at least one vacuum shoe supported by said chassis rearwardly of where said cleaning solution is applied to the floor, wherein cleaning solution drawn into said at least one vacuum shoe is deposited into said at least one second tank, said at least one vacuum shoe being movable between a vacuum shoe stored position and a vacuum shoe operating position, wherein in said vacuum shoe operating position said at least one vacuum shoe draws cleaning solution into said vacuum shoe from the floor, said at least one vacuum shoe being pivotally mounted relative to said chassis, wherein in said vacuum shoe operating position pivotal movement of said at least one vacuum shoe changes the angle of said at least one vacuum shoe relative to said floor.

12. The floor cleaning apparatus as in claim 11, in which a squeegee assembly is fixed relative to said chassis.

13. The floor cleaning apparatus as in claim 12, in which said at least one vacuum shoe is mounted to one end of a bracket pivotally fixed relative to said chassis, wherein pivotal movement of said bracket moves said at least one vacuum shoe between said vacuum shoe stored position and said vacuum shoe operating position.

14. The floor cleaning apparatus as in claim 12, wherein said angle of said at least one vacuum shoe is fixable relative to said floor.

15. The floor cleaning apparatus as in claim 12, in which said squeegee assembly has an operating position and a stored position, wherein in said operating position said squeegee assembly engages the floor.

16. The floor cleaning apparatus as in claim 12, in which a vacuum source supported by said chassis is selectably in fluid communication with at least one of said at least one vacuum shoe and said squeegee assembly, wherein said vacuum source creates a suction for drawing cleaning solution applied to the floor into said at least one second tank.

17. The cleaning apparatus as in claim 12, in which said at least one agitation brush is cylindrical having an axis of rotation transverse to a longitudinal centerline extending through said forward end and said rearward end of said chassis.

18. The cleaning apparatus as in claim 12, in which at least one of said floor engaging wheels is a steerable wheel steerable by a steering wheel supported by said chassis.

19. The floor cleaning apparatus as in claim 11, further comprising:

at least one downwardly directed spray nozzle supported by said chassis proximal said chassis forward end and in fluid communication with said at least one first tank, wherein said cleaning solution from said at least one tank is applied to the floor by the at least one spray nozzle spraying said cleaning solution onto the floor, with the at least one ground engaging agitation brush and the at least one vacuum shoe disposed rearwardly of said at least one spray nozzle.

20. The cleaning apparatus as in claim 19, including a side brush supported by said chassis forwardly of said at least one spray nozzle for urging debris into the path of said cleaning apparatus.

21. A floor cleaning apparatus comprising:

a chassis having a forward end and a rearward end;

a plurality of floor engaging wheels supporting said chassis above a floor;

at least one first tank supported by said chassis for holding a cleaning solution;

at least one second tank supported by said chassis for holding recovered cleaning solution, wherein said cleaning solution from said at least one first tank is applied to the floor;

at least one ground engaging agitation brush for agitating the cleaning solution applied to the floor;

at least one vacuum shoe rearwardly of where said cleaning solution is applied to the floor, wherein cleaning fluid drawn into said vacuum shoe is deposited into said at least one second tank, said at least one vacuum shoe being movable between a vacuum shoe stored position and a vacuum shoe operating position; and a squeegee assembly rearwardly of said at least one agitation brush, wherein cleaning solution drawn into said squeegee assembly is deposited into said at least one second tank, said squeegee assembly being movable between a squeegee assembly stored position and a squeegee assembly operating position, wherein in a squeegee mode, said at least one vacuum shoe is in said vacuum shoe stored position and said squeegee assembly is in said squeegee assembly operating position, and in an extraction mode, said at least one vacuum shoe is in said vacuum shoe operating position and said squeegee assembly is in said squeegee assembly stored position.

22. The cleaning apparatus as in claim 21, in which at least one of said floor engaging wheels is a steerable wheel steerable by a steering wheel supported by said chassis.

23. The floor cleaning apparatus as in claim 21, wherein in a travel mode, said at least one vacuum shoe is in said vacuum shoe stored position and said squeegee assembly is in said squeegee assembly stored position.

24. The floor cleaning apparatus as in claim 21, in which said vacuum shoe is pivotally mounted relative to said chassis, wherein in said vacuum shoe operating position, pivotal movement of said vacuum shoe changes the angle of said shoe relative to said floor.

25. The floor cleaning apparatus as in claim 24, wherein said angle of said shoe is fixable relative to said floor.

26. The floor cleaning apparatus as in claim 21, in which a vacuum source supported by said chassis is selectably in fluid communication with at least one of said at least one vacuum shoe and said squeegee assembly, wherein said vacuum source creates a suction for drawing cleaning solution applied to the floor into said at least one second tank.

27. The floor cleaning apparatus as in claim 21, further comprising:

at least one downwardly directed spray nozzle supported by said chassis proximal said chassis forward end and in fluid communication with said at least one first tank, wherein said cleaning solution from said at least one tank is applied to the floor by the at least one spray nozzle spraying said cleaning solution onto the floor, with the at least one ground engaging agitation brush and the at least one vacuum shoe disposed rearwardly of said at least one spray nozzle.

28. The cleaning apparatus as in claim 27, including a side brush supported by said chassis forwardly of said at least one spray nozzle for urging debris into the path of said cleaning apparatus.

29. The cleaning apparatus as in claim 21, in which said at least one agitation brush is cylindrical having an axis of rotation transverse to a longitudinal centerline extending through said forward end and said rearward end of said chassis.

30. A floor cleaning apparatus comprising:

a chassis having a forward end and a rearward end;

a plurality of floor engaging wheels supporting said chassis above a floor;

at least one first tank supported by said chassis for holding a cleaning solution;

at least one second tank supported by said chassis for holding recovered cleaning solution, wherein said cleaning solution from said at least one first tank is applied to the floor;

at least one ground engaging agitation brush for agitating the cleaning solution applied to the floor;

at least one vacuum shoe rearwardly of where said cleaning solution is applied to the floor, wherein cleaning fluid drawn into said vacuum shoe is deposited into said at least one second tank;

a squeegee assembly rearwardly of said at least one agitation brush, wherein cleaning solution drawn into said squeegee assembly is deposited into said at least one second tank, said squeegee assembly being movable between a squeegee assembly stored position and a squeegee assembly operating position; and a vacuum source supported by said chassis is selectably in fluid communication with at least one of said at least one vacuum shoe and said squeegee assembly, wherein said vacuum source creates a suction for drawing cleaning solution applied to the floor into said at least one second tank, wherein in a squeegee mode, said squeegee assembly is in said squeegee assembly operating position and in fluid communication with said second tank, and in an extraction mode, said at least one vacuum shoe is in fluid communication with said second tank and said squeegee assembly is in said squeegee assembly stored position.

31. The cleaning apparatus as in claim 30, in which at least one of said floor engaging wheels is a steerable wheel steerable by a steering wheel supported by said chassis.

32. The floor cleaning apparatus as in claim 30, in which said at least one vacuum shoe being movable between a vacuum shoe stored position and a vacuum shoe operating position, wherein in the squeegee mode, said at least one vacuum shoe is in said vacuum shoe stored position, and in the extraction mode, said at least one vacuum shoe is in said vacuum shoe operating position.

33. The floor cleaning apparatus as in claim 32, wherein in a travel mode, said at least one vacuum shoe is in said vacuum shoe stored position and said squeegee assembly is in said squeegee assembly stored position.

34. The floor cleaning apparatus as in claim 30, in which said vacuum shoe is pivotally mounted relative to said chassis, wherein in said vacuum shoe operating position, pivotal movement of said vacuum shoe changes the angle of said shoe relative to said floor.

35. The floor cleaning apparatus as in claim 34, wherein said angle of said shoe is fixable relative to said floor.

36. The cleaning apparatus as in claim 30, in which said at least one agitation brush is cylindrical having an axis of rotation transverse to a longitudinal centerline extending through said forward end and said rearward end of said chassis.

37. Method of cleaning a floor comprising:

moving a chassis on a floor;

supporting a squeegee assembly and a vacuum shoe on the chassis for moment therewith;

applying cleaning solution to the floor;

agitating the applied cleaning solution on the floor as the chassis is moved on the floor; and drawing the agitated cleaning solution from the floor by selectively engaging one of the squeegee assembly or the vacuum shoe supported by the chassis and as the chassis is moved on the floor.

38. The method of claim 37, with applying cleaning solution comprising applying cleaning solution unto the floor.

39. The method of claim 38, with applying cleaning solution comprising spraying cleaning solution by nozzles fed by gravity or pumping from a cleaning solution tank supported on the chassis.

40. The method of claim 37, with agitating the applied cleaning solution comprising agitating the applied cleaning solution on the floor by counter rotating brushes.

41. The method of claim 40, with agitating the applied cleaning solution comprising agitating the applied cleaning solution on the floor by counter rotating, cylindrical brushes.

* * * * *